US006308478B1

(12) United States Patent
Kintscher et al.

(10) Patent No.: US 6,308,478 B1
(45) Date of Patent: Oct. 30, 2001

(54) DEVICE FOR CONNECTING REINFORCED CONCRETE SECTIONS

(75) Inventors: Matthias Richard Kintscher, Memmingen; Ralf Avak, Biberach, both of (DE)

(73) Assignee: Pfeifer Holding GmbH & Co. KG, Memmingen (DE)

( * ) Notice: Subject to any disclaimer, the term of this patent is extended or adjusted under 35 U.S.C. 154(b) by 0 days.

(21) Appl. No.: 09/446,903

(22) PCT Filed: Jul. 3, 1998

(86) PCT No.: PCT/EP98/04123

§ 371 Date: Jan. 3, 2000

§ 102(e) Date: Jan. 3, 2000

(87) PCT Pub. No.: WO99/01630

PCT Pub. Date: Jan. 14, 1999

(30) Foreign Application Priority Data

Jul. 3, 1997 (DE) ..... 297 11 542 U
Jul. 3, 1997 (DE) ..... 297 11 544 U

(51) Int. Cl.[7] ..... E04C 5/00

(52) U.S. Cl. ..... 52/223.7; 52/378; 52/379; 52/583.1; 52/259; 52/742.14; 403/291; 403/269

(58) Field of Search ..... 52/418, 223.1, 52/223.6, 223.7, 223.8, 223.9, 223.11, 223.14, 231, 378, 379, 404.2, 404.4, 707, 587.1, 405.3, 259, 432, 433, 583.1, 585.1, 742.14, 125.4, 125.5, 258; 403/291, 269

(56) References Cited

U.S. PATENT DOCUMENTS

| | | | | |
|---|---|---|---|---|
| 3,212,222 | * | 10/1965 | Wittfoht | 52/223.14 |
| 3,555,753 | * | 1/1971 | Magadini | 52/223.7 |
| 3,986,311 | | 10/1976 | Muhe et al. . | |
| 5,799,457 | * | 9/1998 | Schumacher et al. | 52/405.3 |
| 5,809,712 | * | 9/1998 | Simanjuntak | 52/223.7 |
| 6,102,607 | * | 8/2000 | Kintscher | 403/291 |

FOREIGN PATENT DOCUMENTS

| | | |
|---|---|---|
| 94377 | 3/1921 | (CH) . |
| 562376 | 5/1975 | (CH) . |
| 2264938 | 10/1975 | (FR) . |

* cited by examiner

*Primary Examiner*—Carl D. Friedman
*Assistant Examiner*—Jennifer I. Thissell
(74) *Attorney, Agent, or Firm*—Jacobson Holman, PLLC

(57) ABSTRACT

The invention relates to a device enabling reinforced concrete elements (1, 2) to be linked by means of metal cables, certain portions of which are inserted into the just made concrete (1) while the cable portions which are not inserted protrude into the enclosure formed by the second contiguous concrete element (2). The first concrete element (1) presents a reinforcement which terminates in the area of contact with the second concrete element (2). In parallel or extension to said reinforcement of the first concrete element, pieces of metal cable (4) are inserted so as to provide either spaces for locating the cable free ends in the first concrete element, or passages in the enclosure formed by said first concrete element.

21 Claims, 8 Drawing Sheets

DEVICE FOR CONNECTING REINFORCED CONCRETE SECTIONS

BACKGROUND OF THE INVENTION

Field of the Invention

The invention relates to a device for connecting reinforced concrete sections. The device uses wire ropes which are embedded partially in a concrete section which was made first, and the ends which are not embedded protrude into a formwork of a second, adjoining concrete section.

It is known to connect concrete sections by embedding in one concrete section at the abutting surface wire rope loops or the like which then cooperate with corresponding wire rope loops of a second concrete section.

If the second concrete section is of cast in place concrete, it is also possible to concrete the wire rope loops into the second concrete section.

In order to simplify manipulation with the wire rope loops, it is known to provide at the edge of the formwork of a concrete section box-like inserts which receive the wire rope loops. After removal of the formwork, the boxes can be opened, and the wire rope loops which were initially turned in then adopt a position for connection to the adjacent second concrete section.

Wire rope loops of the type mentioned hereinabove can be employed both with cast in place concrete sections and also with pre-cast concrete sections.

It is known furthermore to bend in reinforcements of concrete sections in the edge region such that they are inside the formwork. In this case a box-like insert, for example, can be provided which receives the bent-in reinforcing bars. After removal of the formwork and optionally opening of the boxes, the reinforcing bars are bent out such that a connection to adjacent concrete sections is possible.

It is frequently necessary to use in the concrete section reinforcing bars of sizeable diameter. Increasingly, there is then a risk that the reinforcing bars may crack while being bent back. It also becomes difficult or impossible to bend in the reinforcing bars, as mentioned hereinabove, in the edge region such that the ends are initially within the formwork and are bent up only after removal of the formwork. In the case of reinforcements of sizeable diameter, there are therefore provided for example in the formwork openings through which the reinforcing bars project. It is also known to provide the ends of the reinforcing bars with pressed-on sleeves having an internal thread, such that correspondingly constructed reinforcing bars of the adjacent concrete section can be screwed into these sleeves.

However, the connecting of reinforcing bars of sizeable diameter which are bendable only with difficulty or not at all is altogether very labour-intensive. This is true both when introducing the reinforcement into the formwork and also when removing the formwork and when connecting adjacent concrete sections.

SUMMARY OF THE INVENTION

The object of the invention is to provide a device which enables concrete sections having reinforcements of sizeable diameter to be connected and with which the labour input for connecting the concrete sections is substantially less than with conventional methods.

To achieve this object the invention proceeds from a device of the type indicated at the outset, According to the invention it is proposed that the first concrete section has a reinforcement which terminates in the adjoining region of the second concrete section, that there are arranged parallel to the reinforcement in the first concrete section wire rope pieces for the free ends whereof there are provided receiving spaces in the first concrete section or discontinuities in the formwork of the first concrete section. The wire rope pieces can also, in place of the parallel arrangement, be arranged as an extension of the reinforcement if a suitable transmission of forces into the wire rope is ensured. A reinforcing bar, for example, serves as the reinforcement.

The invention is based on the thinking that a wire rope can be placed under substantially greater tension than a reinforcing bar of the conventional grade of steel. The cross section of the wire rope piece which takes up the tensile forces from the reinforcing bar and transmits them in analogous manner is therefore substantially less than the cross section of the reinforcing bar. This in turn means that the wire rope piece remains sufficiently flexible, such that the accommodation of the free end of the wire rope piece, for example in receiving spaces in the formwork of the first concrete section, is not problematic.

The essential advantages of the device according to the invention are, however, also obtained when there are provided in the formwork of the first concrete section not receiving spaces for the wire rope pieces but discontinuities for the free ends of the wire rope pieces. The drillings in the formwork which are necessary for the wire rope pieces are substantially smaller than equivalent drillings for the reinforcing bars. As the free ends remain movable, they barely inconvenience work in the region of this formwork. The ease of bending is also a substantial advantage during the transportation of pre-cast sections.

In the same manner as in the formwork of the first concrete section the tree ends of the wire rope pieces in the second concrete section can be connected to the reinforcing bars which are to be arranged there. The wire rope pieces then likewise lie for example parallel to the reinforcing bars there. Force transmission then also takes place in the second concrete section because the concrete is connected in fixed manner (adhesion effect) to the wire rope pieces as a result of the surface irregularities thereof, and an anchorage is obtained like that which results from the ribbed texture on the surface of conventional reinforcing bars. It is clear that the anchoring length of the wire rope pieces should be determined appropriately so as to prevent tearing out. While possible, the introduction of additional connections between the wire rope pieces on the one hand and the ends of the reinforcing bars on the other is not necessary.

It is generally sufficient if there is arranged parallel to the reinforcing bar a single wire rope piece for each reinforcing bar. In particular cases, and in particular in the case of very large reinforcing bar diameters, it may however be advisable to arrange a plurality of wire rope pieces parallel to a single reinforcing bar. It is clear that the deformability of the wire rope pieces, being then thinner, is improved as a consequence.

In a further embodiment of the invention there are provided in the first concrete section receiving pockets for the free ends of the wire rope pieces. The free ends of the wire rope pieces can for example be pushed into these pockets. After removal of the formwork the free ends are pulled out of these pockets in order to bring them into the position required for connection to the reinforcing bars of the second concrete section.

According to a further proposal of the invention, the free ends of the wire rope pieces can be rolled up or coiled up, thus improving the ease of handling of the wire rope pieces.

The receiving spaces are formed for example by box-like inserts in the formwork of the first concrete section. In order to prevent ingress of the liquid concrete these box-like inserts are capped. On removal of the formwork, the caps are taken off, and the free wire rope ends are then accessible, The receiving spaces can also be formed by readily removable sheaths on the free ends of the wire rope pieces. For example, the free ends can be capped with a polystyrene sheath from which they can be readily pulled out or bent out after setting of the concrete and removal of the formwork. The remaining receiving openings are filled without particular measures when the second concrete section is prepared.

It is generally sufficient in the invention, as already explained above, if the wire rope pieces are installed to a sufficient length parallel to the reinforcing bars. In particular cases it may be appropriate to arrange anchoring elements at the ends of the wire rope pieces in the first concrete section. Such anchoring elements can, for example, be formed by pressed-on sleeves or also by loops. Such measures are appropriate if for particular reasons the dimensions of the formwork or of the concrete section do not permit the arrangement of sufficient anchoring lengths.

In another variant of the invention, the wire rope pieces which are used are corrugated. Such corrugation can for example be achieved in that a relatively readily deformable steel bar is used in place of one of the strands of the wire rope. The wire rope piece can as a result be corrugated without unacceptable deformation of the wire rope strands of the wire rope.

According to the invention, as explained above, the wire rope piece is arranged parallel to the reinforcing bars in the first concrete section. When the length of wire rope incorporated is sufficient or indeed if additional anchoring means on the wire rope are used, the tensile force which is in each case transmitted from the reinforcing bars will consequently be transmitted into the wire rope. In a variant of the invention it is now proposed that at least at one end the wire rope pieces are connected in fixed manner to rigid lengths of reinforcing bar, with the lengths of reinforcing bar extending parallel to the reinforcing bars of the concrete sections. The fixed connection between the lengths of reinforcing bar and the wire rope pieces can be produced, for example, by clamping sleeves. This embodiment of the invention affords the advantage that the connection of the reinforcing bar to the wire rope piece can be workshop-fabricated, while the lengths of bar should be used on site in the same way as conventional reinforcing bars.

The preferred embodiment of the invention provides the construction of the device as a reinforcement basket for building purposes, with the reinforcement basket having a top beam, a lower beam, a transverse force bar which is crimped and extends between the top beam and the lower beam, and an insulation layer in the region of the crimping, and at least one wire rope piece which takes up the tensile forces which arise.

Reinforcement baskets serve for example to connect to a building a balcony slab, generally of steel-reinforced concrete, or similar structural element. Here, substantially the compressive and tensile forces which arise from flexure and the transverse forces are taken up. An insulation layer ensures that, in order to avoid damage and heat losses which would otherwise occur, heat transmission from the balcony slab or the like into the building is prevented in optimal manner. The reinforcing bars which form the known basket are generally of stainless steel since, in particular in the region of the insulation layer, ordinary steel is prone to rusting, and special steel also has lower thermal conductivity.

The invention accordingly results in incorporation into pre-cast sections with no rigid steel parts standing proud. The rope can be bent out of the way during transportation of the concrete section. The essential advantage of the use of wire rope pieces, however, resides in the possibility of keeping the cross-sectional dimensions of a wire rope piece substantially smaller than the equivalent cross-sectional dimensions of reinforcing bars. Since a wire rope piece can be placed under substantially greater load, smaller cross sections are accordingly sufficient. Smaller cross sections in turn afford substantially reduced thermal conduction.

In an advantageous embodiment of the invention it is provided that the insulation layer serves as formwork, in particular permanent formwork. During the production of the slab which is to be attached, the insulation layer, which is for example of Styropor or other known insulating materials and is arranged on the devices which are embodied in particular as a reinforcement basket, is integrated directly in the slab and serves as permanent formwork, that is to say formwork which remains on the pre-cast concrete element.

It is furthermore provided that the wire rope piece is of stainless steel. The corrosion resistance of these connecting elements is greatly increased owing to such a construction according to the invention. At the same time, however, the use of stainless steel or special steel provides a means of lowering the thermal conduction by comparison with ordinary steel and thus obtaining improved thermal insulation. The smaller cross sections which are usable in favourable manner with the same loading capacity further reinforce this effect.

In one embodiment of the invention the top beam will generally be formed of a wire rope piece since, in particular in the case of overhanging balcony slabs or similar structural components, the top beam transmits the tensile stress. In the case of other examples of use of the invention, on the other hand, the wire rope piece can also form the lower beam. A wire rope piece can also form the transverse force bar.

The wire rope piece of the device according to the invention, in particular of the reinforcement basket, can for example be connected to the reinforcing bars of the adjoining reinforcements in that the wire rope piece runs parallel to the reinforcing bars. The embedding of the wire rope piece in the concrete obviates the need for particular measures for anchoring and for connecting to the adjacent reinforcing bars.

In particular cases, however, it may also be provided that one end of the wire rope piece bears an anchoring element, for example a pressed-on sleeve. A loop constructed at the end of the wire rope piece can also serve for anchoring.

In a modified embodiment of the invention the wire rope piece is connected to the adjoining reinforcing bars by means of compression sleeves.

In another variant of the invention there is arranged in the region of the insulation layer a reinforcing bar whereof at least one end is connected to a wire rope piece by means of a compression sleeve.

The reinforcements of adjacent structural components can also partially include wire ropes. In the region of the insulation layer, the wire rope piece is connected by at least one end thereof to these wire ropes or wire rope pieces, for example by means of compression sleeves.

BRIEF DESCRIPTION OF THE DRAWINGS

The drawing shows schematic representations of some embodiments of the invention, where.

DESCRIPTION OF THE INVENTION

Figure 1:
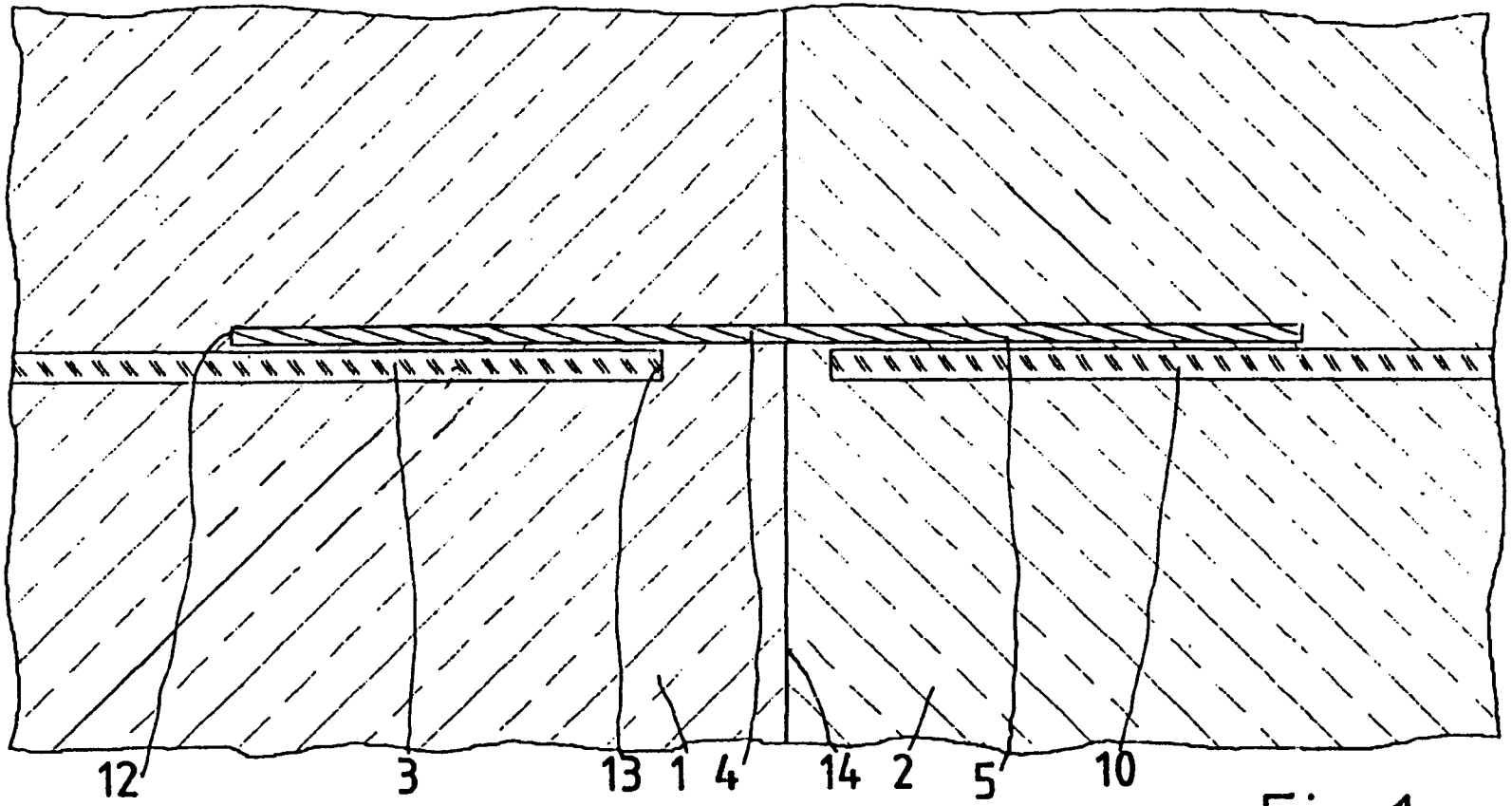
FIG. 1 is a section through two concrete sections having the device according to the invention.

The representation of FIG. 1 shows in the first concrete section 1 a reinforcing bar 3 which extends by means of its end 13 approximately to the edge 14 of the concrete section 1.

Parallel to the reinforcing bar 3 there is installed a wire rope piece 4 whereof the concreted length is selected such that after the introduction of the concrete into the formwork (not shown in detail), there is obtained a secure anchoring of the wire rope piece 4, such that the tensile forces which the reinforcing bar 3 has to take up are reliably transmitted into the wire rope piece 4.

The concreted inner end 12 of the wire rope piece 4 can bear additional anchoring means which are not represented in detail in the drawing.

The embodiment of FIG. 1 proceeds from the wire rope piece at the edge 14 of the concrete section 1 projecting through the formwork. The free end 5 of this wire rope piece is then introduced in analogous manner into the formwork of the second concrete section 2 and runs parallel to the reinforcing bar 10, such that there is obtained a mirror-image construction.

The concrete section 1 can be cast in place. However, the concrete section 1 can also be embodied as a pre-cast concrete section.

Figure 2:
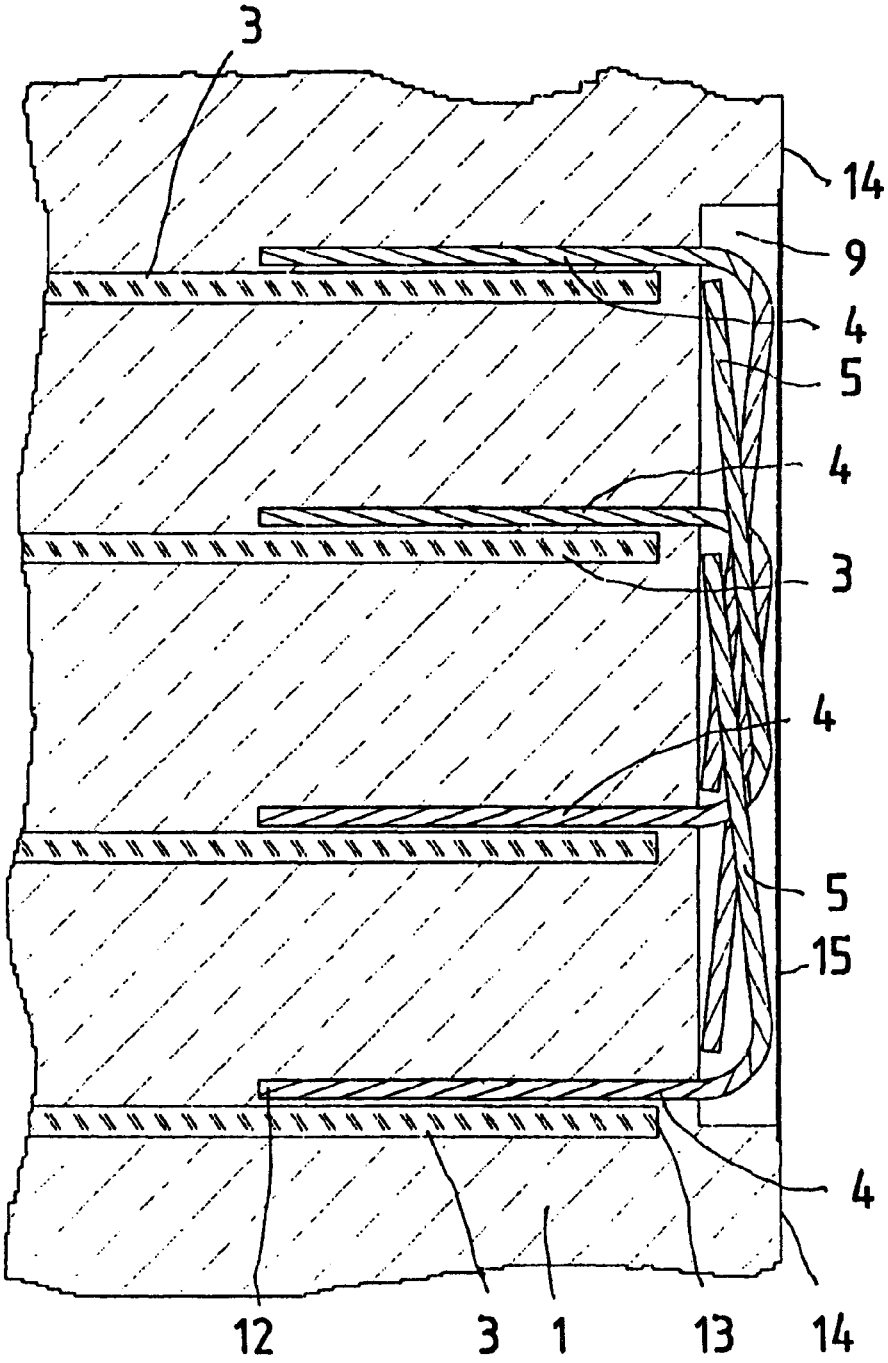
FIG. 2 is a section through the first concrete section prior to connection to the second concrete section, in a modified embodiment of the invention.

In the embodiment according to FIG. 2 there is provided a receiving space 9 which is formed for example by a suitable box of plastics material, sheet metal or the like. This box is closed by a cap 15. The box having the cap 15 receives the free ends 5 of the wire rope pieces 4. After removal of the cap 15 the free ends 5 can be bent up or, owing to their inherent resilience, stand out substantially at right angles from the edge 14 of the first concrete section 1. The connection to the second concrete section is effected in the manner described in conjunction with FIG. 1.

Figure 3:
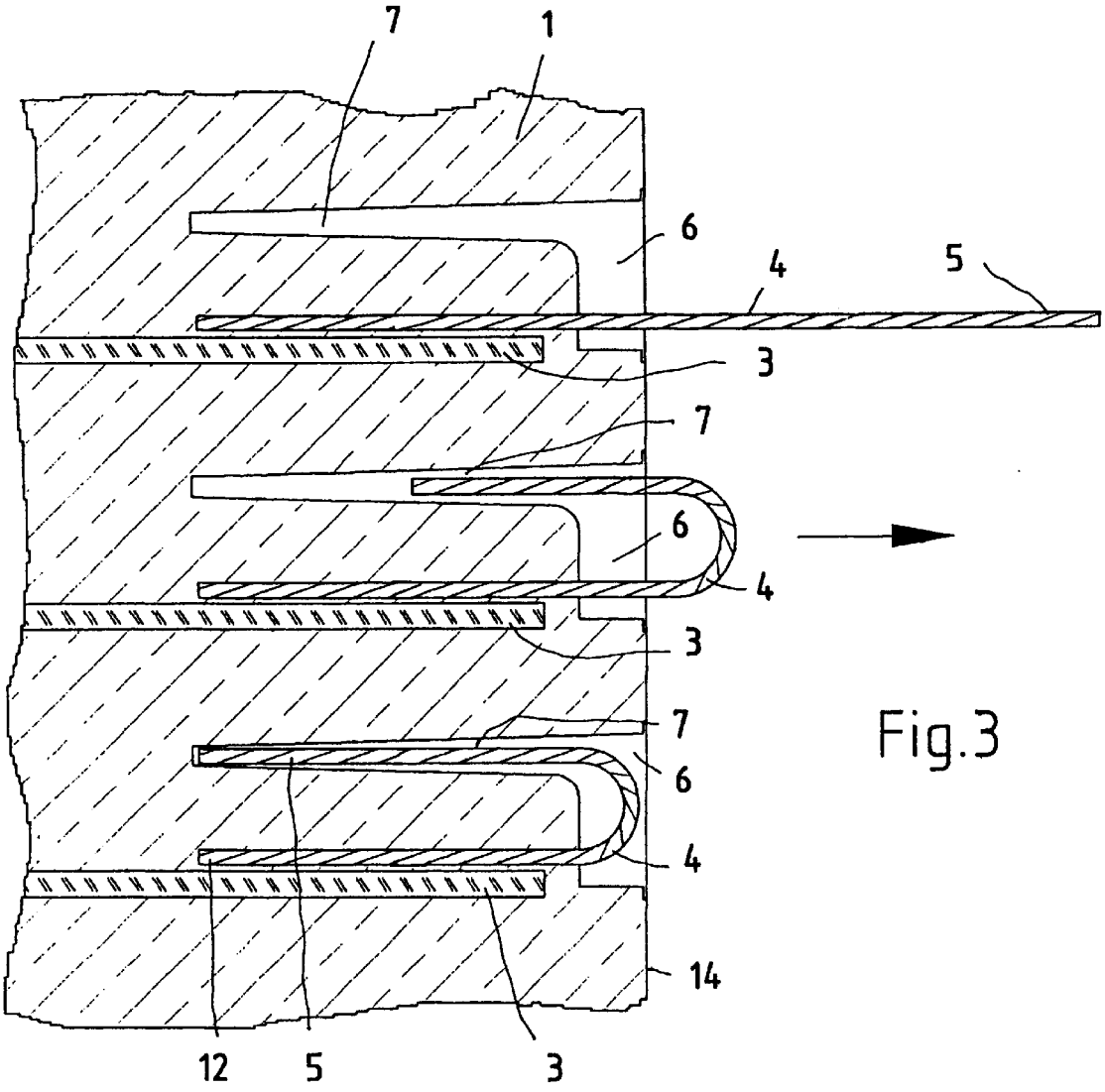
FIG. 3 is a representation of a variant of the invention at various stages in the operation.

In the embodiment according to FIG. 3 it is provided that the wire rope pieces 4 are in each case bent over in the receiving space 6 and pushed into a pocket 7. The receiving spaces 6 and 7 can be formed for example by suitable moulded bodies.

The bottom representation in FIG. 3 shows that position of the wire rope piece 4 which is adopted by the latter during the removal of the formwork. In the middle representation of FIG. 3 the wire rope piece is pulled partially out of the pocket 7. In the top representation of FIG. 3 the wire rope piece 4 stands out at right angles from the edge 14.

Figure 5:
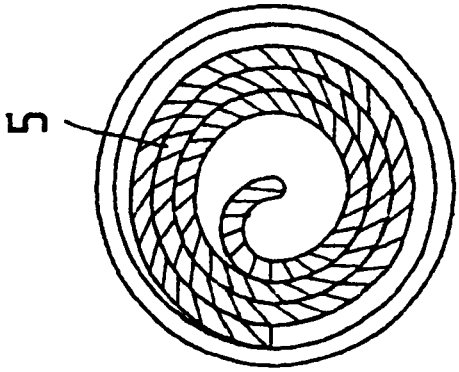
FIG. 5 is a view in the X direction to the representation of FIG. 4, FIGS. 6, 7 are sections through two further embodiments of the invention.
Figure 4:
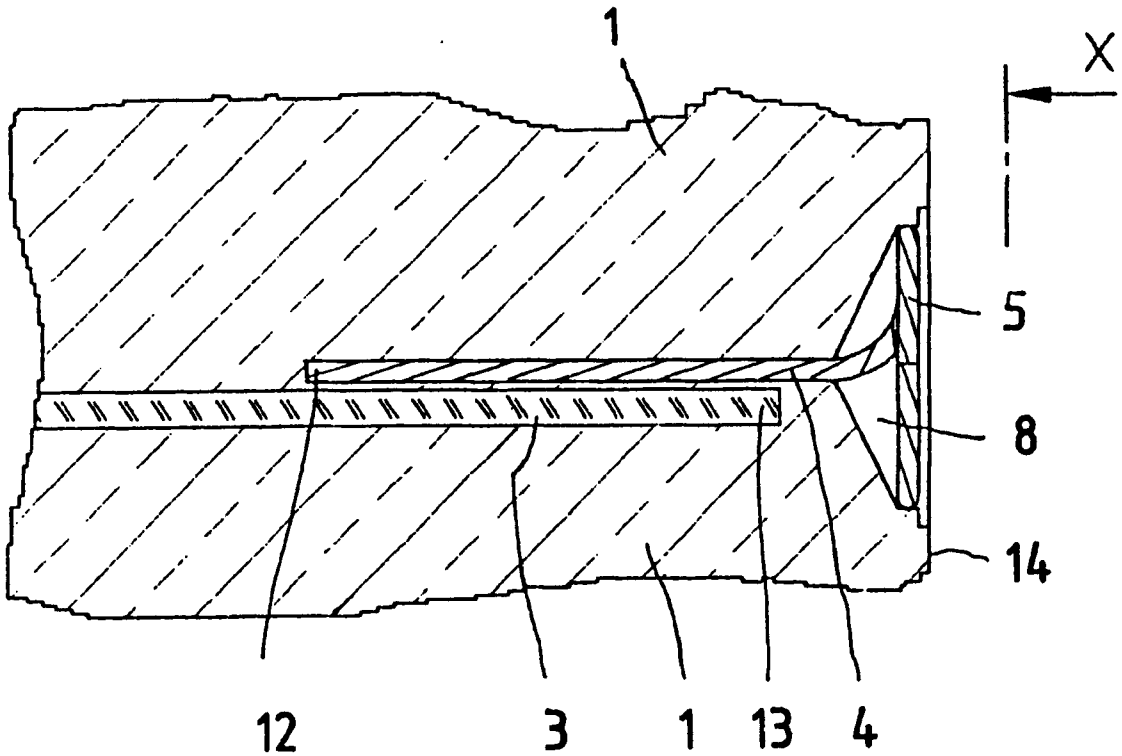
FIG. 4 is a section thorough a further embodiment of the invention.

In the embodiment according to FIGS. 4 and 5, the free end of the wire rope piece 4 is coiled up in the form of a spiral. The spiral form can be secured for example by retaining wires. Moulded bodies, for example also a polystyrene sheath which receives the coil of the free end 5, can also form a receiving space 8 in the concrete section 1. After the removal of the formwork from the concrete section 1 the wire rope piece 4 can be brought by means of the tree end thereof into a position which permits connection to the second concrete section.

In the embodiment according to Fig, 6, the first concrete section 1 and the second concrete section 2 are mutually arranged at an angle. The wire rope piece 4 runs initially parallel to tie reinforcing bar 3, and during production of the concrete section 1 the wire rope piece 4 is accommodated with its free end in the box-shaped receiving space 9.

In the concrete section 2 the free end 5 is then arranged parallel to the reinforcing bar 10. The tensile force is in this way transmitted through the wire rope piece 4 between the reinforcing bars 3, 10.

Figure 7:
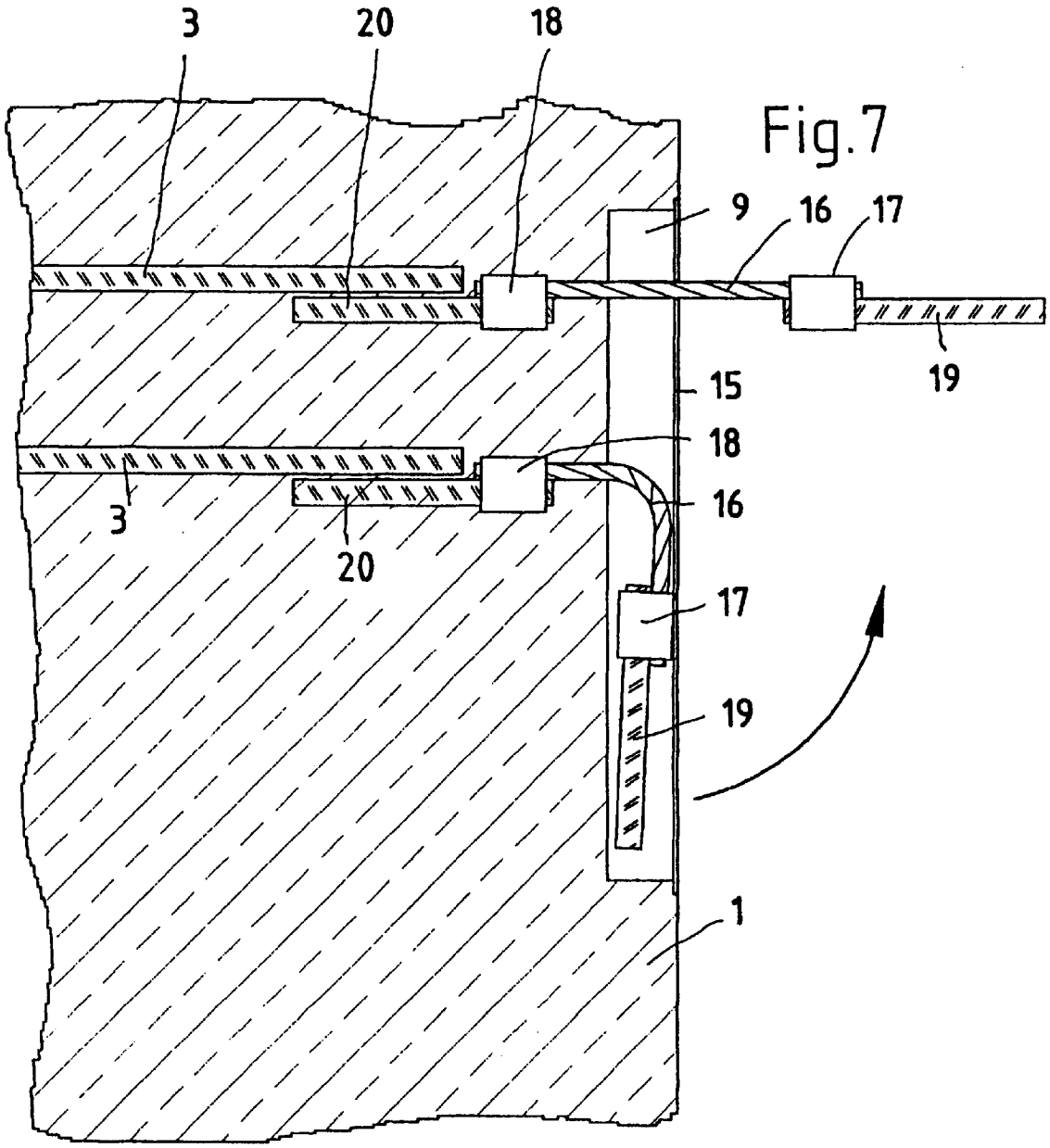

In the embodiment according to FIG. 7 there are used comparatively short wire rope pieces 16 which are connected by respective clamping sleeves 17 and 18 to lengths 19, 20 of reinforcing bar. The longitudinal measurement of the lengths 20 and 19 is ouch that the forces are transmitted from the reinforcing bars 3 of the concrete section 1 into the lengths 20, and then in analogous manner the tensile forces are also transmitted to the reinforcement of the concrete section 2 (not represented here in detail). During the preparation of the concrete section 1 the wire rope pieces 16 are accommodated with the sleeves 17 and the lengths 19, as in the embodiment according to FIG. 2, in the receiving space 9 and can be bent up without problems by removing the cap 15 after the removal of the formwork, as is shown in the top representation in FIG. 7.

Figure 8:
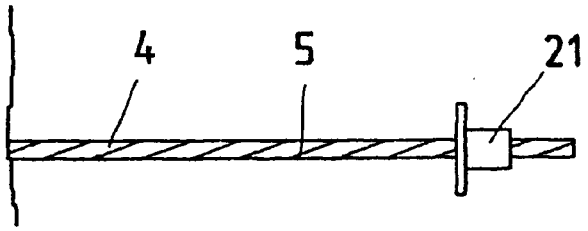
FIGS. 8, 9, 10, 11 are representations of details of the invention.

FIG. 8 shows the free end 5 of a wire rope piece which carries a pressed-on anchoring sleeve 21. The other end of the wire rope piece which is concreted into the concrete section 1 can also be constructed in the same way.

Figure 9:
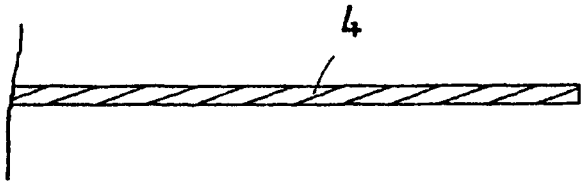

FIG. 9 shows a variant of a wire rope piece 4 without further structural parts.

Figure 10:
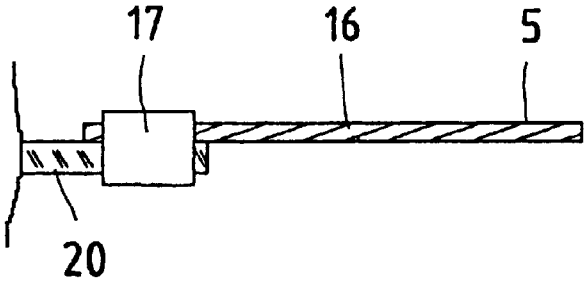

FIG. 10 shows a wire rope piece 16 which is connected, in a manner similar to the embodiment of FIG. 7, by a clamping sleeve 17 to a length 20 of reinforcing bar. The tree end 5 in the embodiment of FIG. 10 can for example be incorporated in the concrete section 2 in a manner similar to the embodiment of FIG. 1.

Figure 11:
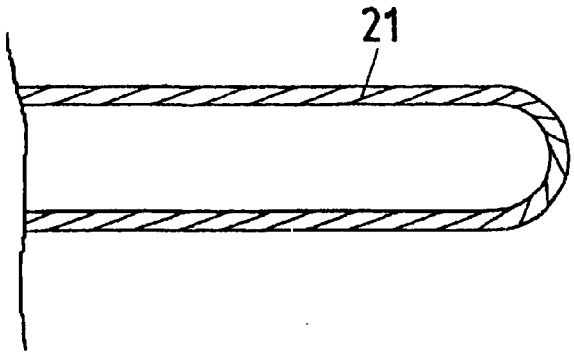

FIG. 11 shows a wire rope piece in the form of a loop 21, with the loop form affording a better anchorage.

As already stated, the essential advantage of the invention resides in the retention of the relative ease of deformation of the reinforcing parts standing proud of the first concrete section, even when the reinforcements incorporated in the concrete section are of relatively large diameter. This in particular avoids cracking of the reinforcement as a result of the application of incorrect bending radii when the structural steel is bent back. A lowering of the fatigue limit in the region of the bending back is moreover also avoided.

As a result it is also possible for reinforcing bars which have been routinely pre-bent at an angle to be replaced with flexible rope ends in accordance with bending plans which conform to specifications (observing relevant regulations)

Figure 6:
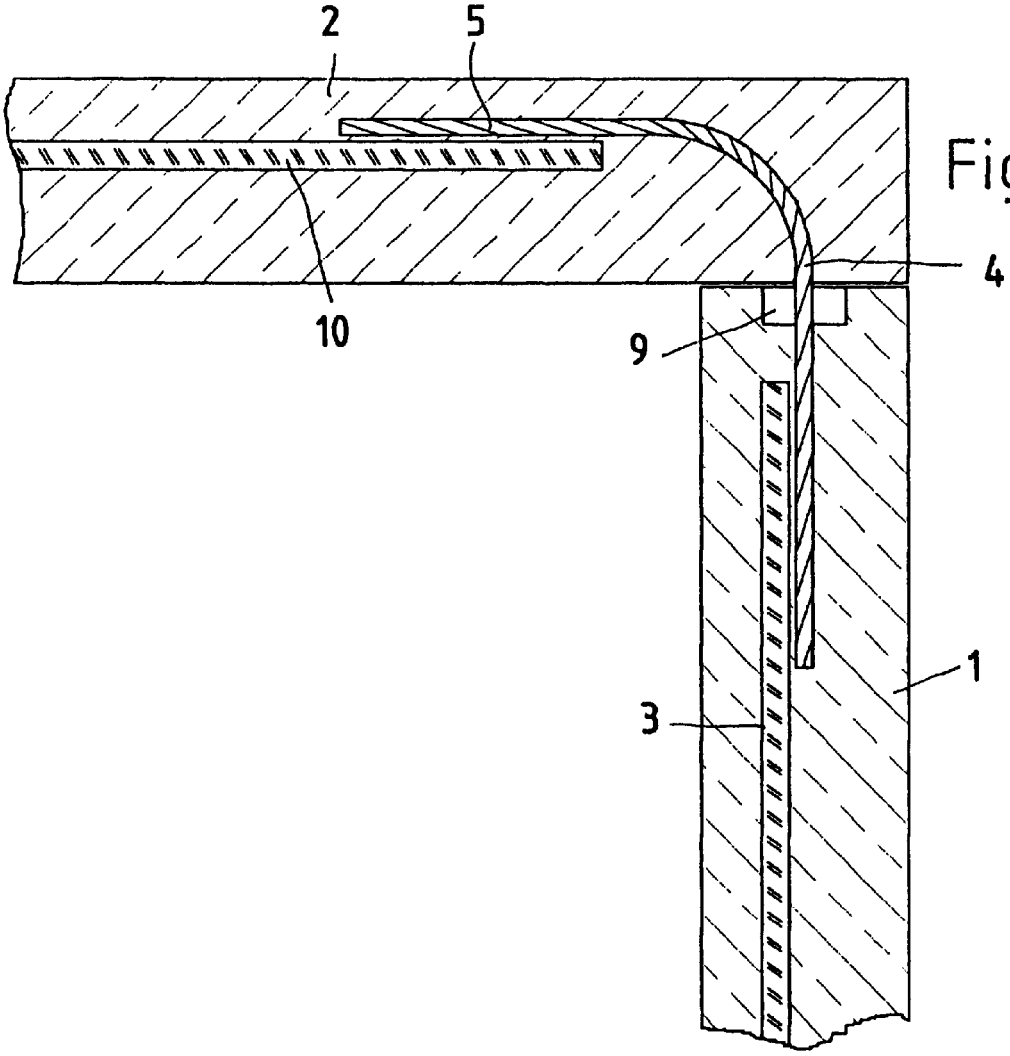

(FIG. 6). This facilitates both short-run supply and stock-holding of standard products rather than costly short-run special production.

In a further embodiment of the invention it is favourable if the free end of the wire rope piece has either at the end or indeed at some distance therefrom a retaining device using which it is possible to connect the flexible wire rope to the armoring of the second concrete section. As a result the rope can be secured rapidly in the armoring, and the disadvantages of the wire rope springing back are eliminated.

Figure 12:
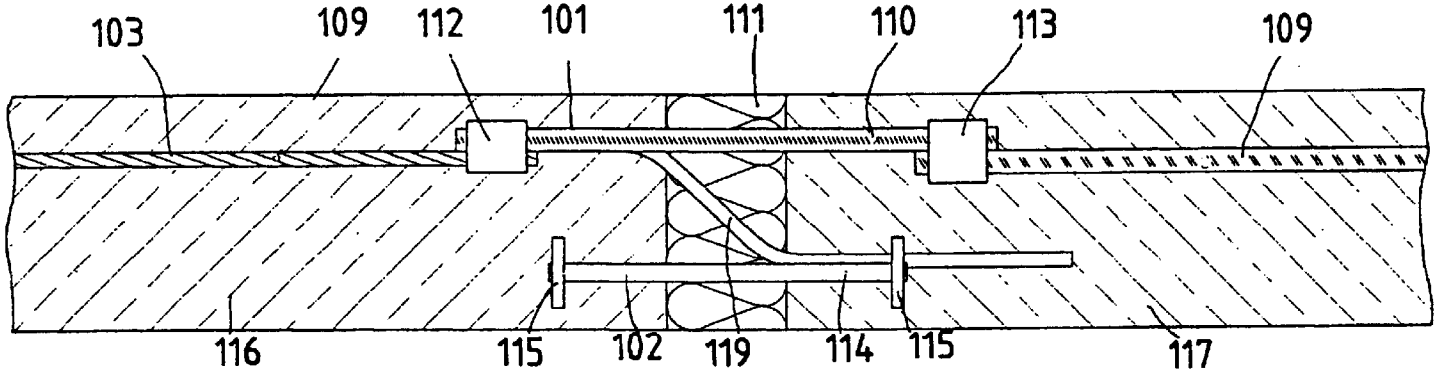
FIG. 12 is a perpendicular section through two adjoining concrete sections, having a device according to the invention embodied as a reinforcement basket.

In the embodiment of FIG. 12 a galvanised wire rope 103 is connected to the reinforcing bar 110 by means of a compression sleeve 112. This reinforcing bar is of stainless steel and has a ribbed external surface. The bar 110 is connected to a conventionally embodied steel reinforcing rod or reinforcing bar 109 by a further compression sleeve 113.

The wire rope piece 103, the reinforcing bar 110 and the reinforcing bar 109 together form the top beam 101 which is conventionally placed under tension. The lower beam 102 is formed of a reinforcing bar 114 which bears at the ends thereof discs 115 to enable it to transmit the compressive forces between the two structural components 116 and 117. The bar 114 is likewise of stainless steel.

Between the top beam 101 and the lower beam 102 there extends the crimped-off transverse force bar 119 which can optionally also be formed of a wire rope. The insulation layer between the structural components 116 and 117 is designated 111.

The reinforcing bar 110, the transverse force bar 119 and the bar 114 of the lower beam 102 can be connected together by means which are not represented in detail, such that there is obtained an installation-ready reinforcement basket. This basket also includes the insulation layer 111.

Figure 13:
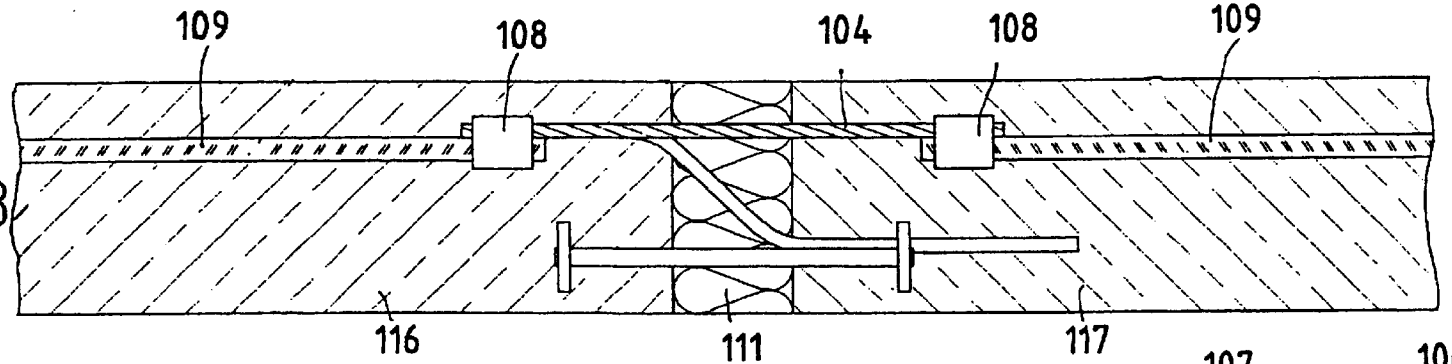
FIGS. 13 and 14 are modified embodiments of the invention.

In the embodiment according to FIG. 13 the wire rope piece 104 is arranged such that it penetrates the insulation layer 111. The wire rope piece 104 is connected in each case to the reinforcing bars 109 of the structural components 116 and 117 by way of the compression sleeves 108.

Figure 14:
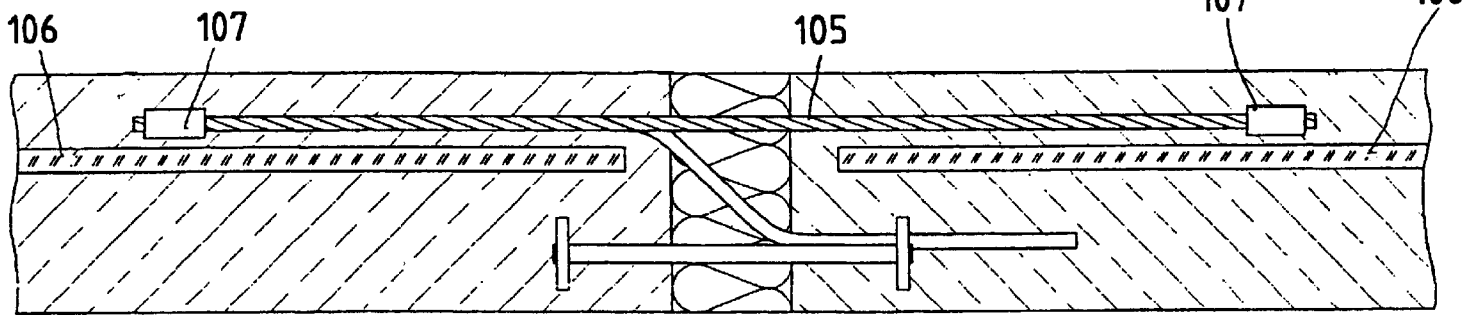

In the embodiment of FIG. 14 the wire rope piece 105 is installed parallel to the reinforcing bars 106, such that the force transmission from the top beam 101 takes place by way of the concrete which surrounds the bars 106 and the wire rope piece 105. Compression sleeves 107 enhance the anchorage.

The wording of the claims submitted with the application at this time and subsequently is without prejudice to the obtaining of further protection.

References in dependent claims back to the main claim relate to the further embodiment of the subject of the main claim by the features of the respective sub-claim. Such back-references should not, however, be interpreted as renouncing, for the features of the related sub-claims, the right to obtain independent protection as subject matter.

Features disclosed hitherto only in the description may during the course of proceedings be claimed as having an importance which is essential for the invention, for example in order to delimit it from the prior art.

What is claimed is:

1. A device comprising at least two reinforced concrete sections and formwork for making each of the concrete sections, wire ropes being provided to connect the concrete sections, some of the wire ropes being embedded partially in one of said concrete section, and the other ends protrude into the formwork of the second, adjoining, concrete section, wherein the first concrete section having a reinforcement and said reinforcement including bars which terminates in the adjoining region of the second concrete section, wire rope pieces arranged parallel to the reinforcement or as an extension of the reinforcement in the first concrete section which when the concrete sections are under load take over and transmit the tensile forces of the reinforcing bars, and for the free ends whereof there are provided receiving spaces in the first concrete section.

2. The device according to claim 1, wherein the free ends of the wire rope pieces of the first concrete section, which protrude into the second concrete section, are arranged parallel to the reinforcing bars or as an extension of the reinforcing bars of the second concrete section.

3. The device according to claim 1, wherein said wire rope pieces are arranged parallel to and as an extension of the reinforcing bars.

4. The device according to claim 1, further comprising receiving pockets in the first concrete section for receiving the free ends of the wire rope pieces.

5. The device according to claim 1, wherein the free ends of the wire rope pieces are rolled up or coiled up.

6. The device according to claim 1, wherein the formwork of the first concrete section having receiving spaces formed by box-like inserts in the formwork of the first concrete section.

7. The device according to claim 1, wherein the free ends of the wire rope pieces have readily removable sheaths forming receiving spaces.

8. The device according to claim 1, wherein the wire rope pieces are corrugated.

9. The device according to claim 1, wherein the free ends of the wire rope pieces are formed into loops.

10. The device according to claim 1, wherein at least one end of the wire rope pieces being connected in a fixed manner to rigid lengths of said reinforcing bar which extend parallel to the reinforcing bars of the concrete sections.

11. The device according to claim 1, wherein the free ends of the wire rope pieces bear retaining devices for connecting these free ends to the reinforcement of the second concrete section.

12. The device according to claim 1, wherein the device is constructed as a reinforcement basket for building purposes, and the reinforcement basket has a top beam, a lower beam, a transverse force bar which is crimped and extends between the top beam and the lower beam, and an insulation layer in the region of the crimping, and at least one wire rope piece for taking up tensile forces which arise.

13. The device according to claim 1, wherein the reinforcement includes said reinforcing bar as a top beam or a lower beam.

14. The device according to claim 12, wherein the insulation layer serves as permanent formwork.

15. The device according to claim 1, wherein the wire rope pieces are stainless steel.

16. The device according to claim 12, wherein the top beam or the transverse force bar or the lower beam is/are formed of a wire rope piece.

17. The device according to claim 1, wherein the wire rope piece bears at least at one end, and said at least one end is an anchoring element and said anchoring element is a pressed-on sleeve.

18. The device according to claim 1, wherein the wire rope piece is connected to the adjoining reinforcing bars, said reinforcing bars and said wire rope pieces are connected by means of compression sleeves.

19. The device according to claim 12, wherein a region of the insulation layer by the reinforcing bar, whereof at least one end is connected to the wire rope piece by means of a compression sleeve.

20. The device according to claim 1, wherein the wire rope piece is connected at least at one end thereof to a wire rope or wire rope piece which forms the adjacent reinforcement in the second concrete section.

21. A process for creating a connection between at least two reinforced concrete sections, using wire rope pieces which are embedded partially one of said concrete sections which was made first and whereof part of said wire rope pieces are free and protrude into a formwork of the second concrete section which is to be attached, bending the free ends of the wire rope pieces out from receiving spaces of that concrete section which was made first and laying the wire rope pieces parallel to or as an extension of the reinforcement, which comprises bars, of the second concrete section into the formwork of this second concrete section and the formwork is then filled with concrete.

* * * * *